US008104111B2

(12) United States Patent
Gross et al.

(10) Patent No.: US 8,104,111 B2
(45) Date of Patent: Jan. 31, 2012

(54) SHOWER DEVICE

(75) Inventors: Juergen Gross, Steinach (DE); Elvira Mangold, Offenburg (DE)

(73) Assignee: Hansgrohe AG, Schiltach (DE)

( * ) Notice: Subject to any disclaimer, the term of this patent is extended or adjusted under 35 U.S.C. 154(b) by 996 days.

(21) Appl. No.: 11/972,953

(22) Filed: Jan. 11, 2008

(65) Prior Publication Data

US 2008/0168600 A1 Jul. 17, 2008

(30) Foreign Application Priority Data

Jan. 16, 2007 (DE) ..... 10 2007 003 417

(51) Int. Cl.
*A47K 3/20* (2006.01)

(52) U.S. Cl. ..... 4/567; 4/514; 4/568; 4/585; 4/596; 4/597; 4/675; 4/676; 4/677; 4/678; 4/599

(58) Field of Classification Search ..... 4/567, 514, 4/596, 568, 585, 597, 599, 600, 601, 605, 4/612, 614, 678, 570, 675, 676, 677, 234, 4/241, 246.1; 239/273, 282, 289, 203
See application file for complete search history.

(56) References Cited

U.S. PATENT DOCUMENTS 2,898,605 A * 8/1959 Pearson ..... 4/567
3,716,192 A 2/1973 Hunter
3,884,258 A * 5/1975 Mull ..... 4/570

(Continued)

FOREIGN PATENT DOCUMENTS

DE 3600322 A1 7/1987

(Continued)

OTHER PUBLICATIONS

Official Action of European Patent Office dated Jul. 21, 2010, in EP 08 000 430.2.

(Continued)

*Primary Examiner* — William Gilbert
*Assistant Examiner* — Patrick Maestri
(74) *Attorney, Agent, or Firm* — Duane Morris LLP

(57) ABSTRACT

A shower device is proposed that features a fixed-installation housing. This housing can, for example, stand up from the floor and may extend beyond normal human body size. The housing is fitted with a shower arm that can be moved out of an inactive position. In the inactive position, the surface of the shower arm lies flush with the surface of the housing. The jet discharge area of a shower head arranged in the shower arm faces inwards, so that it is only possible to see a flat surface on the exterior of the housing. Through pressure on this surface, a catch mechanism is released and this causes the shower arm to move out of the housing. This is accomplished via a drive mechanism, which may feature a spring, for example. Extension is performed at a relatively slow speed, which can be achieved using a damper device. The shower arm moves to a position in which the now-visible jet discharge disc of the shower head can be used as an overhead shower. The use position effected via the drive mechanism can also, however, be adjusted by the user, without impeding the drive mechanism. After use, the user can move the shower arm back into the housing manually, which will then cause the spring to be re-tensed. It is hereby intended that the shower arm features an overhead shower. However, it is also possible to design the shower arm in a lower position and for a different purpose.

29 Claims, 6 Drawing Sheets

U.S. PATENT DOCUMENTS

Figure 1:
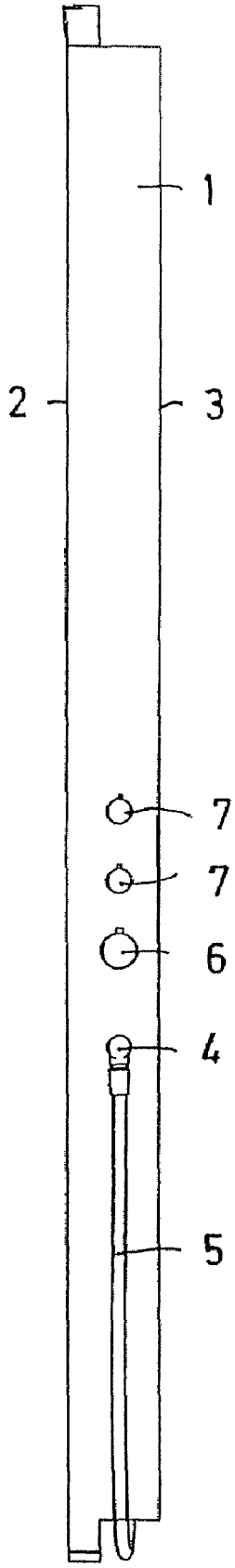

| | | | | | |
|---|---|---|---|---|---|
| 4,912,783 | A | * | 4/1990 | Shafer | 4/246.1 |
| 5,369,814 | A | * | 12/1994 | Denys | 4/246.2 |
| 5,465,435 | A | * | 11/1995 | Malvaez et al. | 4/574.1 |
| 5,604,936 | A | * | 2/1997 | Mausolf | 4/246.1 |
| 5,836,050 | A | | 11/1998 | Rumez et al. | |
| 6,147,416 | A | | 11/2000 | Mitsuzuka | |
| 6,934,974 | B1 | * | 8/2005 | Pantos et al. | 4/246.1 |

FOREIGN PATENT DOCUMENTS

| | | | |
|---|---|---|---|
| DE | 4442547 | C1 | 6/1996 |
| DE | 29813597 | U1 | 12/1998 |
| DE | 20000618 | U1 | 3/2000 |
| DE | 20010748 | U1 | 8/2000 |
| DE | 20211120 | U1 | 11/2002 |
| DE | 10253840 | A1 | 6/2004 |
| DE | 10253849 | A1 | 6/2004 |
| DE | 200402131 | A1 | 11/2005 |
| JP | 03110228 | A | 5/1991 |

OTHER PUBLICATIONS

European Patent Office, Search Report for European Patent Appln. 08000430.2, dated May 6, 2009. (See p. 2 for relevance table.)

* cited by examiner

SHOWER DEVICE

The invention relates to a shower device with at least one shower head.

A shower system is known (DE 298 13 597) that features an elongated housing and a shower arm. In the upper area of the housing, the shower arm is guided around a horizontal axis and can be swivelled from a vertical swivel position to a horizontal position.

The task of the invention is to create a shower device that does not present any markedly protruding parts when not in the use position, and which can be shifted to the use position with little effort.

To solve this task, the invention proposes a shower device with the characteristics specified in Claim 1. Further embodiments of the invention are the subject matter of sub-claims.

The shower device thus contains a housing that is, for example, attached to the wall of a shower cell. The housing is fitted with a shower arm that features an inactive position when the shower device is not to be used, and in which it lies largely flush with the surface of the housing. It therefore does not present any protruding parts. In order to then use the shower device, it is provided that the shower arm is conveyed to a use position through activation of a drive mechanism, and in this use position the jet discharge disc is arranged in such a way that the user can shower.

In further embodiments of the invention it can be provided that the aforementioned drive mechanism is solely used to convey the shower arm from the inactive position to the use position. The reverse movement of the shower arm, i.e. when the user has finished showering, can be performed manually by the user. The user pushes or swivels or otherwise moves the shower arm back to its inactive position.

In particular, it can be provided that the drive mechanism for the shower arm features a spring which, in the inactive position of the shower arm, is tensed sufficiently to store the energy required for conveying the shower arm to the use position. The spring is tensed via the reverse movement performed manually by the shower user.

In particular, it can be provided that this drive mechanism features a coil spring. This can be very conveniently situated in a space that is narrow but long in one direction. Furthermore, this is a standard component, which is always available in varying sizes and with varying characteristics.

It is also possible, and is proposed by the invention, to use a drive mechanism with a gas pressure spring.

Another option in line with the invention is to use a drive mechanism that can be activated by water pressure.

The spring-driven movement of the shower arm can risk causing overly sudden extension of the shower arm out of the inactive position. To prevent this, further embodiments in accordance with the invention can provide for a drive mechanism that has a damping device to slow down the extension of the shower arm to the use position.

Further embodiments in accordance with the invention can provide for a drive mechanism with a lever gear and/or cogwheel gear.

In particular, it can be provided that the damping device features a rotational damper that also enables damping within a small space when a rotating movement occurs in the drive mechanism.

This rotational damper can therefore in particular be associated with the lever gear and/or with the cogwheel gear.

The rotational damper can, for example, be connected to the housing via the cogwheel gear.

It can be provided that the rotational damper performs a movement relative to the housing.

The drive mechanism is used to put the shower arm in the use position. This use position can be determined in advance through the adjustment of stops or similar. In further embodiments of the invention, it is proposed that the user be able to adjust the shower arm in both directions by a specified amount with relation to the use position, and to do this without impeding the drive mechanism.

For the inactive shower arm position, a detent can be provided to ensure that the shower arm lies truly flush with the surface of the housing, without it being possible for influences from the drive mechanism to change this position.

To activate the drive mechanism, it can be provided that it is activated via operation of the stop valve assigned to the shower head of the shower arm. This can be a special valve movement caused, for instance, by the user pressing or pulling the operating knob of this valve.

Another option is for the drive mechanism to be simply activated by opening the stop valve.

If, in addition to the shower head attached to the shower arm, the shower device also features another shower head, for instance a hand-held shower head, there is a switching valve that determines which shower head is put into operation. In further embodiments of the invention, it can here be provided that the drive mechanism for extending the shower arm is activated by the user shifting the switching valve lever to the shower head arranged in the shower arm. Here, it can also be provided that the switching lever of this switching valve moves back to a neutral position after use. This can also be accomplished by manually moving the shower arm back to the inactive position.

A further especially advantageous option for activating the drive mechanism of the shower arm is for the user to press on the shower arm when it is in its inactive position, causing the catch mechanism to be triggered and thereby allowing the drive mechanism to operate. Such push-push sequences are common for electric switches.

In further embodiments of the invention, it can be provided that the water supply to the shower head assigned to the shower arm is conducted or performed through the shower arm mount on the housing. This mount can be designed in such a way that there are no externally visible line connections.

In further embodiments of the invention, it can particularly be provided that the shower arm is swivel-mounted, and preferably around a horizontal axis. In this case, the water supply passes through the swivel axis without any extra devices.

To ensure that the shower arm surface lies flush with the housing surface under all possible conditions, further embodiments in accordance with the invention can provide that the mount for the shower arm is designed to be adjustable at least with regard to height and at least on one side. Especially when the shower arm is of a certain length, even slight deviations from a straight progression can have an optically disturbing effect. This can be prevented if the mount is adjustable.

In accordance with the invention, it can also be provided that the shower head is arranged on or in the shower arm in such a way that its jet area is directed towards the interior of the housing, and is therefore not visible when in the inactive position. The surface of the housing including the surface of the shower arm can then blend into a smooth surface.

With a swivel-mount, further embodiments can provide that the drive mechanism engages the swivel-mount, which forms the swivel axis, on the side turned away from the shower head, so that the drive mechanism is not visible in the extended state, nor during extension.

In accordance with the invention, the invention proposes to arrange the shower arm in such a way that the shower head positioned within it can be used as a head shower.

Further embodiments of the invention can provide for the inclusion of a second shower arm, arranged somewhat lower, which also features a drive mechanism for conveying it from the inactive position to the use position. This second shower arm may be one that can be used when the user wishes only to shower from the shoulders down, for example, in order not to get his/her hair wet.

Further embodiments of the invention can provide for the inclusion, in the lower area of the housing, of a foot rest that can be folded out of the housing in a similar or identical manner as the shower arms of the middle and upper areas.

In new further embodiments of the invention, it can be provided that, in the lower area of the housing, another shower arm is included in which the jet area of the shower head is, for example, directed upwards when in the use position. Here it is also conceivable, however, that the jet area is directed downwards. For this shower arm, it can be provided that the jet area of the shower head attached to the shower arm may be optionally directed upwards or downwards. This can be performed, for instance, through a varying movement of the shower arm out of the housing. It is therefore conceivable, for instance, via the aforementioned pressure on the shower arm in its upper area, to perform downwards extension with the jet area directed upwards and, via pressure on the shower arm in its lower area, to perform upwards extension with the jet area directed downwards.

In further embodiments of the invention, it can be provided that this shower arm is designed as a foot rest.

In new further embodiments of the invention, it can be provided that the shower arms are free from operating elements for the shower itself, so that all operating elements including the switching valves are arranged on the housing.

Figure 2:
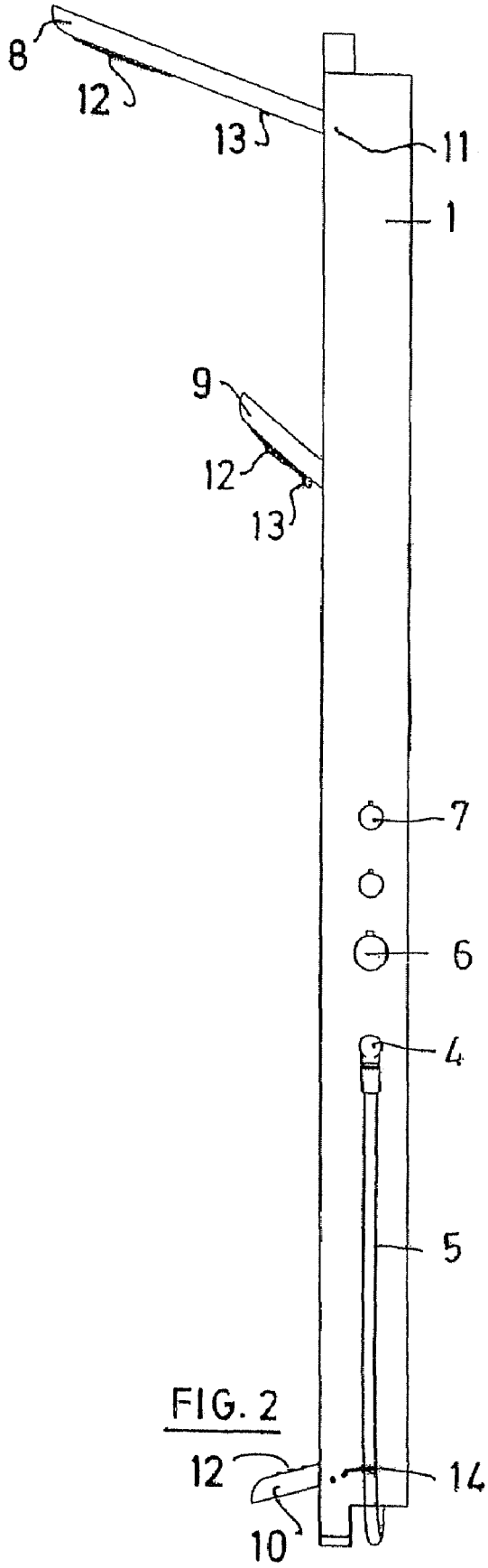
Figure 3:
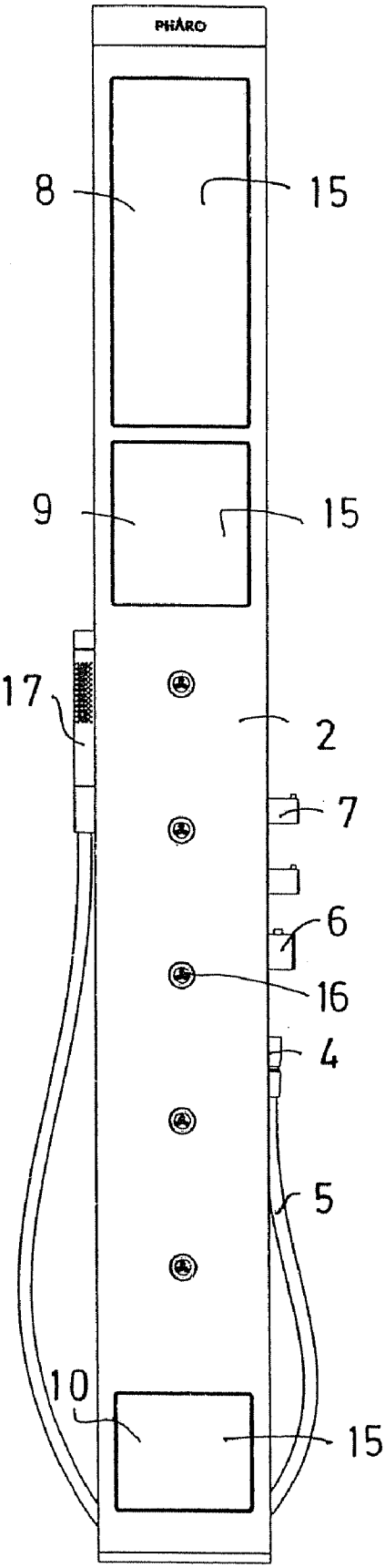
Figure 4:
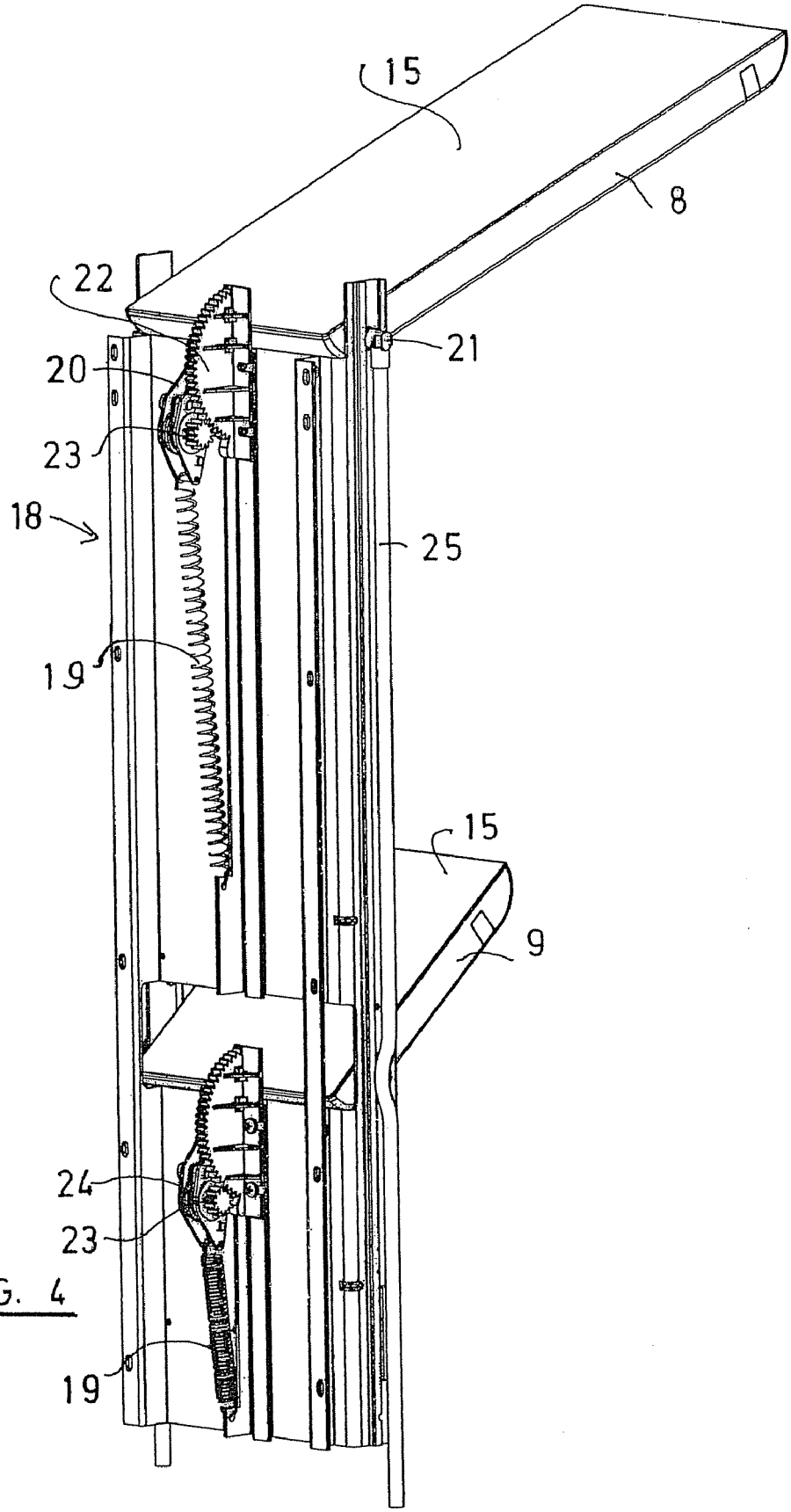
Figure 5:
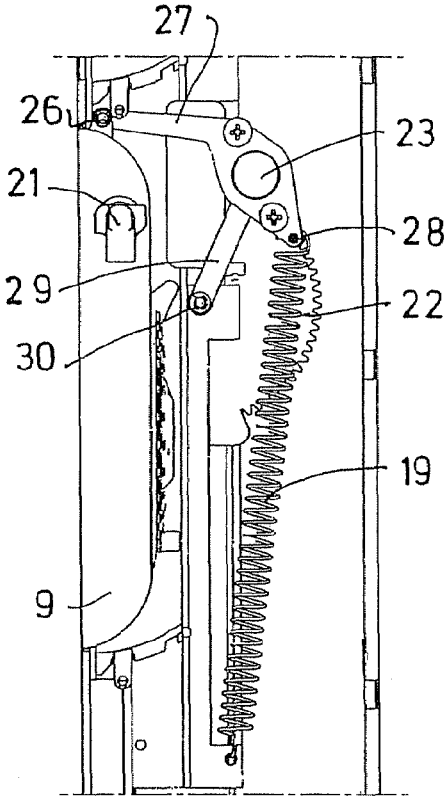
Figure 6:
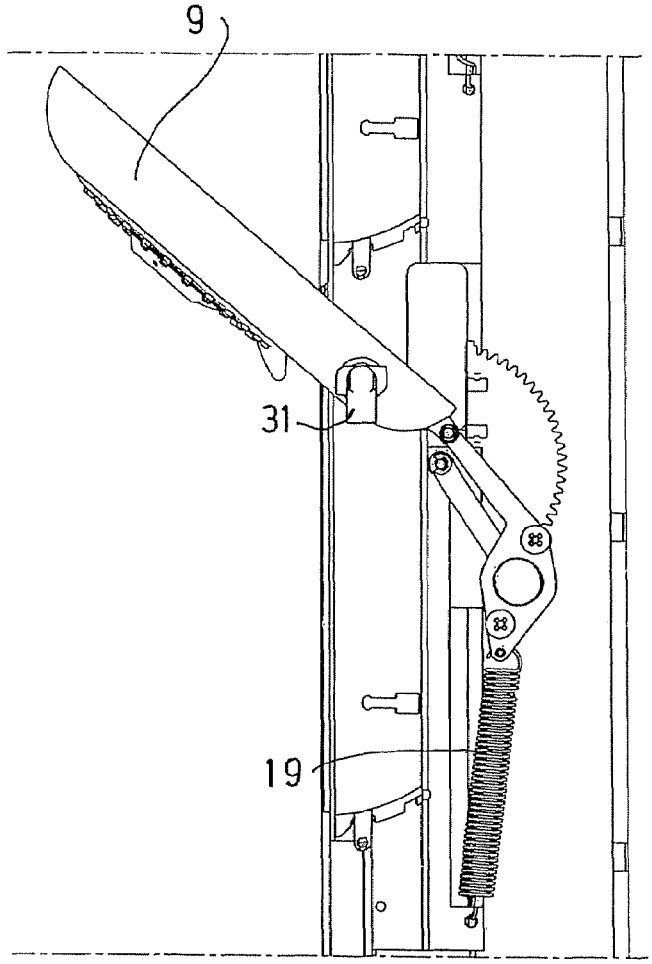
Figure 7:
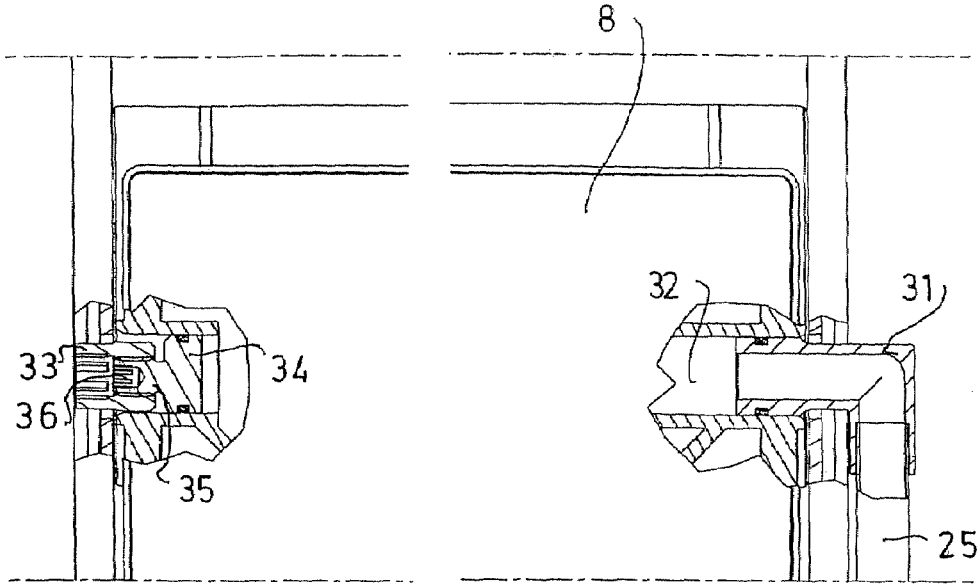
Figure 8:
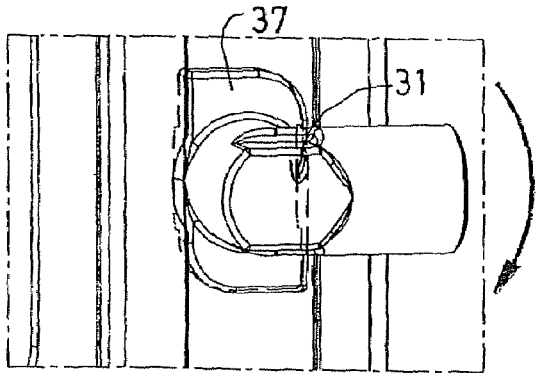
Figure 9:
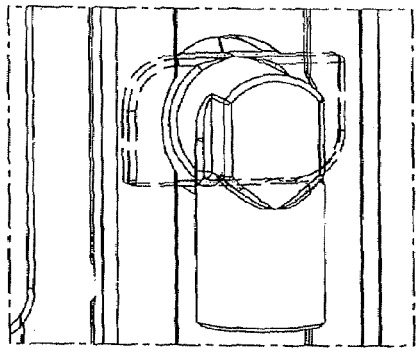
Figure 10:
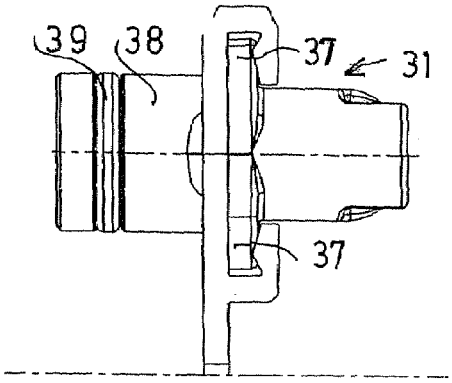
Figure 12:
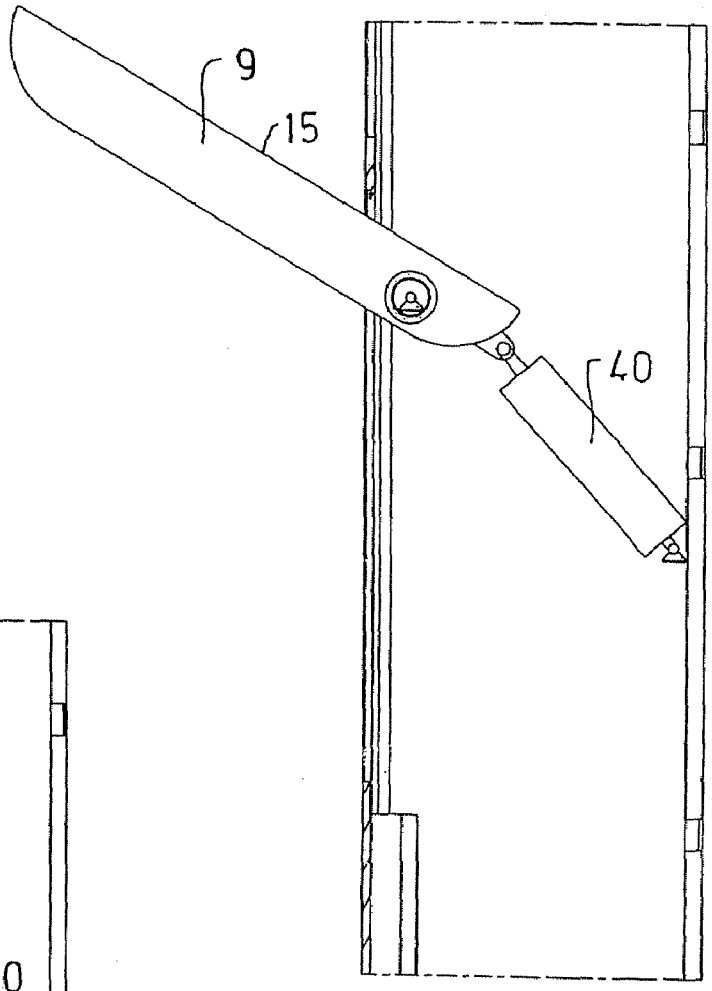
Figure 11:
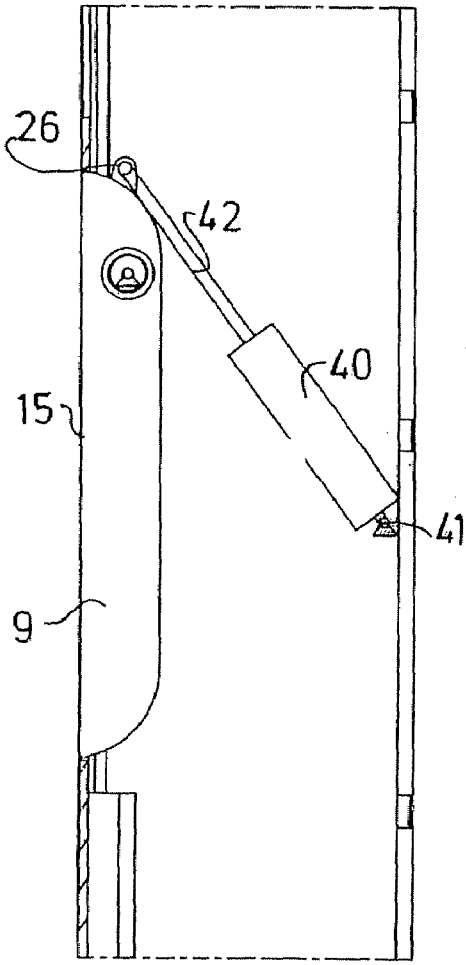

Further features, details and benefits of the invention are evident from the claims and the summary, the wording of which becomes the content of the description, from the following description of preferred embodiments, as well as based on the technical drawings, where the drawings depict:

FIG. 1 side view of a housing of a shower device proposed by the invention in the inactive state;

FIG. 2 view of the shower device in FIG. 1 with extended shower arms;

FIG. 3 view of the shower device in FIG. 1 from left in FIG. 1;

FIG. 4 perspective view of the shower device from the rear;

FIG. 5 single view of the drive mechanism in the inactive position;

FIG. 6 the drive mechanism in the open position of the shower arm;

FIG. 7 a cross-section through the swivel-mount of a shower arm;

FIG. 8 a single view of the mount;

FIG. 9 view from FIG. 8 in the swivelled state;

FIG. 10 a cross-section through the mount of the shower arm;

FIG. 11 a depiction corresponding to FIG. 5 with a gas pressure spring and FIG. 12 a depiction corresponding to FIG. 6 with the gas pressure spring as drive mechanism.

FIG. 1 shows the side view of a shower device in accordance with the invention. This shower device contains a housing 1, of which one side wall can be seen in FIG. 1. On the left in FIG. 1, one can see the front side 2, which is thus directed towards the interior of the shower cell. On the right in FIG. 1, one can see the back side 3 which, after assembly of the housing 1, is covered by the wall of the shower cell or the bathroom. A connector 4 for a shower head hose 5 is arranged on the depicted side wall of the housing 1, and this connector 4 leads to a hand-held shower head which is not visible in FIG. 1 and FIG. 2. Above the connector 4 for the shower head hose 5 are arranged operating elements 6, 7 for sanitary fittings that are situated inside the housing 1. These are stop valves and switching valves. As it is possible to see from FIG. 1, there are no protrusions that extend beyond the front side 2 of the housing 1 into the shower cell.

FIG. 1 shows the inactive position of the shower device. In its housing 1, the shower device contains multiple shower arms 8, 9, 10 that can be moved out of the front side 2 of the housing 1. In the depiction of FIG. 2, these shower arms have moved out of the inactive position, in which their exteriors lie flush with the front side 2 of the housing 1, to the use position. In the upper end area of the housing 1, a shower arm 8 is swivel-mounted on an indicated rotation axis 11. The rotation axis 11 runs vertical to the plane of the drawing, and therefore horizontal and parallel to the back wall of the housing 1. In the shown use position, the shower arm 8 is arranged at an angle of around 15 to 30° from horizontal, and has therefore been swivelled out from the housing by around 105 to 110°. A shower head is arranged in the shower arm 8, and the jet discharge surface 12 of this shower head is arranged on the interior 13 of the shower arm, which is now directed downwards. When water flows through the shower head and its jet discharge disc 12, a jet leaving this jet discharge disc 12 is directed slanting downwards.

Below the directly aforementioned swivelled-out shower arm 8, a second shower arm 9 is arranged that runs at a somewhat steeper angle than the upper shower arm 8. This shower arm also features a jet discharge area 12 for a shower head on its interior 13.

In the lower end area, there is a third shower arm 10, in which the jet discharge disc 12 is directed upwards. This shower arm 10 can be swivelled around an axis 14 which, in the inactive position, is situated at the lower end of the shower arm 10. For the upper shower arms 8, 9 this is different, as the swivel axis there is situated at the upper end of the shower arm 8, 9.

The lower shower arm 10 can be used to shower the soles of the feet, while the middle shower arm 9 is used, for example, to shower from the shoulders down. The aforementioned switching valves and stop valves 6, 7 are used to control the different shower heads in the different shower arms 8, 9, 10.

In the depicted embodiment, the lower shower arm 10 is simultaneously designed as a foot rest. It is also possible, and it lies in the scope of the invention, to design such a foot rest so that it can be moved out of the housing in the same way as a shower arm, but without equipping it with a shower head.

FIG. 3 shows a front view of the housing of the shower device, thus from the left in FIG. 2. Here, it is possible to see that the back sides 15 of all shower arms 8, 9, 10 form rectangular surfaces that are designed to be smooth and without any discontinuities. Their side edges run parallel to the side walls of the housing 1. Multiple side shower heads 16 are also provided in the front area 2 of the housing 1, and these side shower heads can also be controlled via the aforementioned valves 6, 7. The end of the shower head hose 5, which is attached at 4, is provided with a hand-held shower head 17, which is fitted in a holder on the side wall of the housing 1 lying opposite the connector 4.

FIG. 4 shows a perspective view of the housing with the swivelled-out shower arms 8, 9 from the rear. A drive mechanism 18 is provided to swivel each of the shower arms 8, 9, and this drive mechanism is situated in the housing 1 of the shower device. Each drive mechanism 18 includes a coil tension spring 19 that engages with a lever gear 20 on the shower arm 8, 9. In the depicted embodiment, both shower arms 8, 9 are each mounted with a rotational mount 21 in the tracks of the housing 1. The drive mechanism 18 engages with the side of the shower arm 8, 9 that is turned away from the shower head.

In the housing, a stationary toothed lock washer 22 is provided, along which a cogwheel 23 moves, which meshes with the tooth rim of the toothed lock washer. A rotational damper 24 is operationally connected with the cogwheel 23. When the shower arms are opened, the cogwheel 23 rolls on the tooth rim 22 and thereby sets the rotational damper in rotation, with this rotation leading to deceleration of the movement.

On the right in FIG. 4, it is possible to see that a supply line 25 leads to the rotational mount 21. Via this supply line and the rotational mount 21, water reaches the interior of the shower arm 8 and is discharged from here through the shower head and into the open air.

Details of this design emanate from the FIGS. 5 and 6, to which reference is now made. FIGS. 5 and 6 shows the design of the middle shower arm 9, with the inactive position shown in FIG. 5 and the use position shown in FIG. 6. The rotational mount of the shower arm 9 is provided in Point 21. A lever rod 27 is hinged at 26 at the upper end of the shower arm 9, and the other end of this lever rod is connected with the free end 28 of the coil tension spring 19. A cogwheel 23, which rolls along the tooth rim 22, is mounted on the lever rod 27. For this, it is controlled by a guider 29 that is mounted on the housing at 30. After the cogwheel 23 has rolled along the tooth rim 22, the shower arm 9 reaches the upper end position, which is depicted in FIG. 6.

The cut-off depiction of FIG. 7 shows the rotational mount for the shower arms 8, 9, 10. An angle element 31 is located on the end of the line 25. The side of this angle element 31 extends into the interior of the shower arm 8. There, a part of the water duct 32 for the shower head is arranged inside the shower arm 8 and is connected in a fluid-conveying manner with this inner side of the angle unit 31.

On the side of the shower arm lying opposite, a port 33 is mounted in a track of the housing 1, and an attachment 34 is inserted in this port from the inner side. This attachment 34 features an excentric stud 35 that engages with the port 33. It can be rotated by inserting a wrench into the wrench cavity 36, so that the excentricity is modified in its position relative to the port 33. In this way, the left end of the mount shaft for the shower arm 8 can be shifted upwards or downwards, to the front or to the back. This makes sense in order to establish parallelity between the edges of the visible exterior 15 of the shower arms and the side walls of the housing.

FIG. 8 shows that a locking attachment 37 with two flanks is formed on the angle unit, and this locking attachment can be inserted in the tracks in the position of FIG. 8. Through rotation of the angle unit 31, the side flanks reach the side grooves of the slit, so that the angle unit 31 is now locked, see FIG. 9. Now the line end of the line 25 can be inserted in the attachment from below.

The position of the flanks for the locking attachment 37 emanates from the cross-section of FIG. 10. Here, it is also possible to see that the inward-directed part 38 of the angle unit 31 is provided with a seal 39 that seals the line conduit 32 in the interior of the shower arm 8.

While the embodiments described up to now, in particular with reference to the FIGS. 4 to 6, showed a gear appropriate to the particular circumstances of a coil tension spring, the FIGS. 11 and 12 show the use of a gas pressure spring 40 for the same purpose. On the upper end of the middle shower arm 9 in the retracted position, one end of the gas pressure spring 40 is hinged at one joint 26 and the other end is attached to the back wall of the housing 1 at 41. The gas pressure spring pulls the piston rod 42 inwards and thereby swivels the shower arm 9 outwards in the clockwise direction indicated in FIGS. 11 and 12.

The respective drive mechanisms are activated via a fastening device that is not depicted but which is known to the state of the art, and which is opened by pressing and closed again by pressing a second time in the case of retraction.

In the depicted embodiment, the movement of the shower arms out of the housing constitutes a swivel movement around a fixed axis. This has the advantage of highly simple water supply to the interior of the shower arms. It is also possible, however, to provide for a sliding shower arm movement, if necessary along a curved path, which would also fulfill the purpose of moving the shower arms from a non-obtrusive inactive position to a use position that extends into the interior of the shower cell.

What is claimed is:

1. Shower device comprising:

a housing adapted for fixed installation, a shower arm attached to the housing and having at least one shower head, the shower arm having an inactive position in which the shower arm lies flush with a surface of the housing and a use position in which a jet discharge disc of the shower head is arranged to discharge water for showering;

a drive mechanism for conveying the shower arm from the inactive position to the use position, wherein the drive mechanism comprises a gear arranged to rotate on a lever rod, wherein the drive mechanism is only used to convey the shower arm from the inactive position to the use position; and, a damping device for damping the movement of the shower arm, the damping device comprising a rotational damper connected with the lever gear.

2. Shower device according to claim 1, wherein the drive mechanism comprises a spring that is tensed by retraction of the shower arm to the inactive position.

3. Shower device according to claim 1, wherein the drive mechanism comprises a pressure cylinder for exerting force.

4. Shower device according to claim 1, wherein the rotational damper moves relative to the housing.

5. Shower device according to claim 1, wherein the use position to which the drive mechanism moves the shower arm is manually adjustable to a specific position of the shower arm relative to the housing.

6. Shower device according to claim 1, further comprising a detent determining the inactive position of the shower arm.

7. Shower device according to claim 1, wherein the drive mechanism can be activated by operating a stop valve assigned to the shower head of the shower arm.

8. Shower device according to claim 1, wherein the drive mechanism can be activated by switching a switching valve leading to the shower head of the shower arm.

9. Shower device according to claim 1, wherein the drive mechanism can be activated via manual pressure on the shower arm when in the inactive position.

10. Shower device according to claim 1, wherein water is supplied to the shower head of the shower arm through a mounting of the shower arm on the housing.

11. Shower device according to claim 1, wherein the shower arm is swivel-mounted on the housing.

12. Shower device according to claim 1, wherein the shower head is directed towards an interior of the housing when the shower arm is in the inactive position.

13. Shower device according to claim 1, wherein the shower arm is configured such that the shower head can be used as an overhead shower, and further comprising a second shower arm arranged on the housing below the overhead shower.

14. Shower device according to claim 13, wherein both the shower arm and the second shower arm are provided with a drive mechanism in a same manner.

15. Shower device comprising:

a housing adapted for fixed installation, a shower arm attached to the housing and having at least one shower head, the shower arm having an inactive position in which the shower arm lies flush with a surface of the housing and a use position in which a jet discharge disc of the shower head is arranged to discharge water for showering;

a drive mechanism for conveying the shower arm from the inactive position to the use position, wherein the drive mechanism comprises a rotatable a cogwheel gear, wherein the drive mechanism is only used to convey the shower arm from the inactive position to the use position; and, a damping device for damping the movement of the shower arm, the damping device comprising a rotational damper connected with the cogwheel gear.

16. Shower device according to claim 15, wherein the drive mechanism comprises a spring that is tensed by retraction of the shower arm to the inactive position.

17. Shower device according to claim 15, wherein the drive mechanism comprises a pressure cylinder for exerting force.

18. Shower device according to claim 15, wherein the rotational damper is connected with the housing via the cogwheel gear.

19. Shower device according to claim 15, wherein the drive mechanism can be activated by opening a stop valve assigned to the shower head of the shower arm.

20. Shower device according to claim 15, wherein the shower arm is configured such that the shower head can be used as an overhead shower, and further comprising a second shower arm arranged on the housing below the overhead shower.

21. Shower device according to claim 20, wherein both the shower arm and the second shower arm are provided with a drive mechanism in a same manner.

22. Shower device according to claim 15, wherein the rotational damper moves relative to the housing.

23. Shower device according to claim 15, wherein the use position to which the drive mechanism moves the shower arm is manually adjustable to a specific position of the shower arm relative to the housing.

24. Shower device according to claim 15, further comprising a detent determining the inactive position of the shower arm.

25. Shower device according to claim 15, wherein the drive mechanism can be activated by switching a switching valve leading to the shower head of the shower arm.

26. Shower device according to claim 15, wherein the drive mechanism can be activated via manual pressure on the shower arm when in the inactive position.

27. Shower device according to claim 15, wherein the shower arm is swivel-mounted on the housing.

28. Shower device according to claim 15, wherein the shower head is directed towards an interior of the housing when the shower arm is in the inactive position.

29. Shower device according to claim 15, wherein water is supplied to the shower head of the shower arm through a mounting of the shower arm on the housing.

* * * * *